US011111889B2

(12) United States Patent
Roesgen et al.

(10) Patent No.: US 11,111,889 B2
(45) Date of Patent: Sep. 7, 2021

(54) RECIRCULATION MODULE AND FUEL PREFILTER UNIT

(71) Applicant: MANN+HUMMEL GmbH, Ludwigsburg (DE)

(72) Inventors: André Roesgen, Remshalden (DE); Pius Trautmann, Stuttgart (DE); Idriss Razgani, Tangier (MA); Dietmar Talmon-Gros, Oberstenfeld (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 0 days.

(21) Appl. No.: 16/838,478

(22) Filed: Apr. 2, 2020

(65) Prior Publication Data

US 2020/0325863 A1 Oct. 15, 2020

(30) Foreign Application Priority Data

Apr. 10, 2019 (DE) ..... 10 2019 109 388.0

(51) Int. Cl.

| | |
|---|---|
| ***F02M 37/48*** | (2019.01) |
| ***F02M 37/50*** | (2019.01) |
| ***F02M 37/00*** | (2006.01) |
| ***F02M 37/22*** | (2019.01) |

(52) U.S. Cl.

CPC .... *F02M 37/0035* (2013.01); *F02M 37/0052* (2013.01); *F02M 37/22* (2013.01); *F02M 37/48* (2019.01); *F02M 37/50* (2019.01)

(58) Field of Classification Search

CPC .... F02M 37/0035; F02M 37/50; F02M 37/48; F02M 37/0052; F02M 37/22

USPC ..... 123/514

See application file for complete search history.

(56) References Cited

U.S. PATENT DOCUMENTS

| | | | | |
|---|---|---|---|---|
| 4,187,813 | A * | 2/1980 | Stumpp | F02M 37/0035 123/510 |
| 5,269,276 | A * | 12/1993 | Brown | F02M 37/0052 123/514 |
| 6,527,947 | B1 | 3/2003 | Channing et al. | |
| 2011/0011372 | A1* | 1/2011 | Sturgess | F02M 37/0035 123/495 |
| 2012/0204833 | A1 | 8/2012 | Yonemoto | |

(Continued)

FOREIGN PATENT DOCUMENTS

| | | | | |
|---|---|---|---|---|
| DE | 102005062592 | A1 | 6/2007 | |
| FR | 2891023 | A1 * | 3/2007 | F02M 31/125 |

*Primary Examiner* — Mahmoud Gimie
(74) *Attorney, Agent, or Firm* — James Hasselbeck

(57) ABSTRACT

A recirculation module for a fuel prefilter unit of a combustion engine has a temperature-controlled actuating element that transfers the recirculation module, based on a filter raw side feed temperature of the fuel, from a cold start state into a normal operating state and back. In cold start state, an engine return line from the combustion engine to the recirculation module is in fluid communication with a filter element raw side of the fuel prefilter unit and the engine return line is separated in regard to fluid communication from a tank return line of the combustion engine. In normal operating state, the engine return line is separated in regard to fluid communication from the filter element raw side and is in fluid communication with the tank return line. A check valve prevents return flow of fuel from the tank return line into the engine return line.

12 Claims, 13 Drawing Sheets

(56) References Cited

U.S. PATENT DOCUMENTS

| | | | | |
|---|---|---|---|---|
| 2014/0000727 | A1* | 1/2014 | Fisher | F02M 37/0052 137/468 |
| 2016/0138536 | A1* | 5/2016 | Park | F02M 37/0052 123/514 |
| 2018/0128219 | A1* | 5/2018 | Kapp | F02M 37/04 |

* cited by examiner

RECIRCULATION MODULE AND FUEL PREFILTER UNIT

BACKGROUND OF THE INVENTION

The present invention concerns a recirculation module for a fuel prefilter unit for filtering fuel supplied to an internal combustion engine and a fuel prefilter unit with such a recirculation module.

A motor vehicle, for example, a truck, comprises in most cases an internal combustion engine, for example, a diesel engine. The internal combustion engine can have correlated therewith an injection system, in particular a diesel injection system. The injection system can comprise a tank, fuel injectors, and a fuel prefilter unit for filtering fuel, for example, diesel fuel. The fuel prefilter unit is arranged in this context between the tank and the fuel injectors. Particularly when using diesel fuel at low temperatures, in particular when cold starting the internal combustion engine, paraffins can precipitate that may clog a filter element of the fuel prefilter unit. Therefore, it may be necessary to preheat the diesel fuel in order to dissolve these paraffins or to prevent their precipitation. For preheating the diesel fuel, either an electrical heating module that is plugged into the fuel prefilter unit may be provided or the filter element may be supplied with heated fuel return flows from the injection system. This use of the heated fuel return flows is referred to as recirculation.

U.S. Pat. No. 6,289,879 B1, EP 1 843 036 B1, and U.S. Pat. No. 9,163,596 B2 each describe recirculation circuits or valves for such recirculation circuits.

SUMMARY OF THE INVENTION

It is therefore object of the invention to provide an improved recirculation module for a fuel prefilter unit.

Accordingly, a recirculation module for a fuel prefilter unit for filtering fuel supplied to an internal combustion engine is proposed. The recirculation module comprises a module housing, a temperature-controlled actuating element accommodated in the module housing and configured to transfer the recirculation module, as a function of a feed temperature of the fuel at a filter raw side, from a cold start state, in which an engine return line from the internal combustion engine to the recirculation module is in fluid communication with a raw side of a filter element of the fuel prefilter unit and in which the engine return line is separated in regard to fluid communication from a tank return line of the tank of the internal combustion engine, into a normal operating state, in which the engine return line is separated in regard to fluid communication from the raw side of the filter element and in which the engine return line is in fluid communication with the tank return line, and vice versa. The recirculation module comprises a check valve accommodated in the module housing which prevents a return flow of fuel from the tank return line into the engine return line.

Herein, a "module" or a "modular configuration" is to be understood as a component or a component group that can be handled as a whole and in particular can be exchanged as a whole. In particular, the recirculation module comprises preferably all components required for its functionality such as, for example, connectors, a valve body, the check valve, the actuating element, a spring element, the housing module, and so on. In particular, an electrical heating module of the fuel prefilter unit can be exchanged in a simple and fast way for the recirculation module. The cold start state can be referred to in particular as recirculation operating state. The module housing is in particular a one-piece, preferably a monolithic, component. The recirculation module can be referred to also as recirculation valve, cold start module, or cold start valve.

The actuating element can be referred to also as actor or actuator. That the actuating element is "temperature-controlled" is to be understood in particular such that the actuating element is configured, when a temperature change of the feed temperature occurs, to move a plunger either out of a housing of the actuating element or return it into the housing. In particular, the actuating element is suitable to linearly extend the plunger for a temperature increase of the feed temperature and to linearly retract the plunger again for a temperature reduction of the feed temperature. For example, the actuating element can be a wax expansion element or wax motor but also a bimetal actor. In principle, the actuating element can however be any suitable temperature-controlled component that can move another component, in particular linearly displace it, upon temperature change.

Herein, "filter raw side" means at the raw side of the filter element of the fuel prefilter unit. The "feed temperature" is in this context the temperature of the fuel at the raw side of the filter element. The feed temperature can change in operation of the internal combustion engine, for example, increase. The filter element comprises also a clean side that is separated from the raw side by means of the filter medium. The fuel flows in operation of the fuel prefilter unit through the filter medium from the raw side to the clean side and is cleaned thereby from foreign matter, for example, suspended particles. Of course, it is however understood that the recirculation module according to the invention is not limited to a use with a fuel prefilter unit but likewise can also be used in fuel main filter units.

That in the cold start state the engine return line "is in fluid communication" with the raw side of the filter element is to be understood in particular such that the engine return line is connected in fluid communication with the raw side so that the fuel in the cold start state can flow from the engine return line to the raw side. That in the cold start state the engine return line is "separated in regard to fluid communication" from the tank return line is to be understood in particular such that the engine return line is not connected in fluid communication with the tank return line or is out of fluid communication with the tank return line so that the fuel in the cold start state cannot flow from the engine return line to the tank return line. This applies correspondingly to the normal operating state.

The check valve is in particular an umbrella valve that is manufactured from an elastomeric material, for example, a thermoplastic polyurethane, rubber or silicone. The check valve can also be a ball valve, however. In particular, the check valve is suitable to prevent a return flow of fuel into the recirculation module itself. The check valve prevents sucking in air bubbles from the engine return line upon actuation of a manual pump of the fuel prefilter unit. The manual pump is actuated in order to pump fuel into the fuel prefilter unit upon exchange of the filter element. The fuel prefilter unit is preferably a diesel fuel prefilter unit or can be referred to as such. The fuel is accordingly preferably diesel fuel and the internal combustion engine is preferably a diesel engine.

Because the recirculation module is of a modular design, an electrical heating module can be replaced by means of the recirculation module in a simple and fast way. An adaptation of the fuel prefilter unit is not required in this context. By means of the recirculation module, in comparison to an electrical heating module, more energy can be introduced into the fuel at the raw side of the filter element. This prevents reliably precipitation of paraffins from the fuel and thus gelling or clogging of the filter element when cold starting the internal combustion engine.

In embodiments, the actuating element is configured to move the recirculation module into an intermediate state which is between the cold start state and the normal operating state and in which the engine return line is connected in fluid communication with the raw side of the filter element as well as with the tank return line. Preferably, a plurality of intermediate states are provided between the cold start state and the normal operating state.

In embodiments, the recirculation module comprises moreover a valve body which is accommodated in the module housing and, by means of the actuating element, is linearly displaceable in the module housing in order to transfer the recirculation module from the cold start state into the normal operating state, and vice versa. Preferably, in the module housing a substantially cylindrical bore is provided in which the valve body is accommodated. The valve body can be moved in the bore linearly along a longitudinal direction of the bore and opposite to the longitudinal direction. The actuating element is in particular suitable to move or displace the valve body within the bore.

In embodiments, the recirculation module comprises moreover a spring element which is accommodated in the module housing and spring-pretensions the valve body in the direction toward the actuating element. The spring element is preferably also accommodated in the bore. The spring element is preferably a pressure spring. The spring element can be a cylinder spring. Preferably, the actuating element and the spring element interact for displacing the valve body. The valve body, viewed in the longitudinal direction, is arranged in particular between the actuating element and the spring element.

In embodiments, the valve body comprises a first sealing section and a second sealing section arranged at a spacing to the first sealing section, wherein the first sealing section in the cold start state separates the engine return line from the tank return line in regard to fluid communication and wherein the second sealing section in the normal operating state separates the engine return line from the raw side of the filter element in regard to fluid communication. Preferably, the valve body comprises a rod-shaped base section at which the first sealing section and the second sealing section are arranged. Preferably, the sealing sections are cylinder-shaped or barrel-shaped. The sealing sections and the base section form a one-piece, in particular a monolithic, component.

In embodiments, the module housing comprises a bore in which the actuating element and the valve body are accommodated, wherein the bore has correlated therewith at least one opening provided in the module housing which is connected in fluid communication with the raw side of the filter element, wherein a first return channel opens into the bore and is connected in fluid communication with the engine return line, wherein a second return channel opens into the bore and is connected in fluid communication with the tank return line, wherein in the cold start state the first sealing section closes the second return channel and the second sealing section is arranged such that the at least one opening is connected in fluid communication with a first bore section of the bore, wherein in the normal operating state the first sealing section opens the second return channel and the second sealing section is arranged such that the at least one opening is separated in regard to fluid communication from the first bore section, and wherein the valve body closes the first return channel neither in the cold start state nor in the normal operating state. Preferably, two oppositely positioned openings are provided. The openings connect the bore with an environment of the recirculation module. The bore provided in the module housing comprises a second bore section in addition to the first bore section. The at least one opening is positioned between the first bore section and the second bore section.

In embodiments, the module housing comprises an outer surface which is embodied corresponding to an interface provided at the fuel prefilter unit for an electrical heating module. Preferably, the module housing comprises also a fastening interface. The fastening interface may comprise a plurality of bores with which the recirculation module can be fastened to the fuel prefilter unit, in particular screwed thereto. The fastening interface of the recirculation module is in particular constructed identically to a fastening interface of the electrical heating module. The fastening interface can comprise a plurality of bores through which the fastening screws can be passed.

In embodiments, the recirculation module moreover comprises a sealing element provided at the outer surface, in particular an O-ring, for fluid-tight sealing of the module housing relative to the interface. Preferably, at the outer surface at least one annular groove is provided in which the at least one sealing element is accommodated. Preferably, two sealing elements are provided between which the at least one opening of the module housing is positioned. Alternatively, also precisely one sealing element can be provided.

According to a preferred embodiment, two axially spaced apart sealing elements are arranged at the outer surface, in particular at axial positions which adjoin the opening at opposite sides so that the opening of the module housing can be sealed relative to the filter head.

In yet another embodiment, the diameter of the outer surface can be of different size at the axial positions at opposite sides of the opening, in particular, the outer surface can have a smaller diameter at an axial position which faces, in the arrangement of use, the filter head than at the axial position which adjoins axially the other side of the opening. This provides the advantage that the recirculation module can be mounted easily and with comparatively minimal mounting forces.

In embodiments, the actuating element projects from the module housing. In particular, the housing of the actuating element projects from the module housing. In operation of the fuel prefilter unit, the fuel at the filter raw side flows about the housing.

Moreover, a fuel prefilter unit for filtering fuel of an internal combustion engine is proposed. The fuel prefilter unit comprises a recirculation module as disclosed and a filter head that comprises an interface in which the module housing is at least with sections thereof accommodated wherein the actuating element at least with sections thereof is arranged at a raw side of a filter element of the fuel prefilter unit.

The filter element can be part of the fuel prefilter unit. The filter element is exchangeable. The filter element can be screwed onto the filter head so that the filter element can be exchanged easily and quickly. In operation of the fuel prefilter unit, filter raw side fuel that flows into the filter element flows about the actuating element. The interface is particularly suitable to receive an electrical heating module as has been explained above. This means that the electrical heating module as well as the recirculation module can be mounted in or at the interface. The electrical heating module and the recirculation module in this context are mutually exchangeable. The interface can be a bore provided at the filter head, in particular a conically tapering bore.

BRIEF DESCRIPTION OF THE DRAWINGS

In the Figures, same or functionally the same elements, inasmuch as nothing to the contrary as indicated, are provided with the same reference characters.

DESCRIPTION OF PREFERRED EMBODIMENTS

Figure 1:
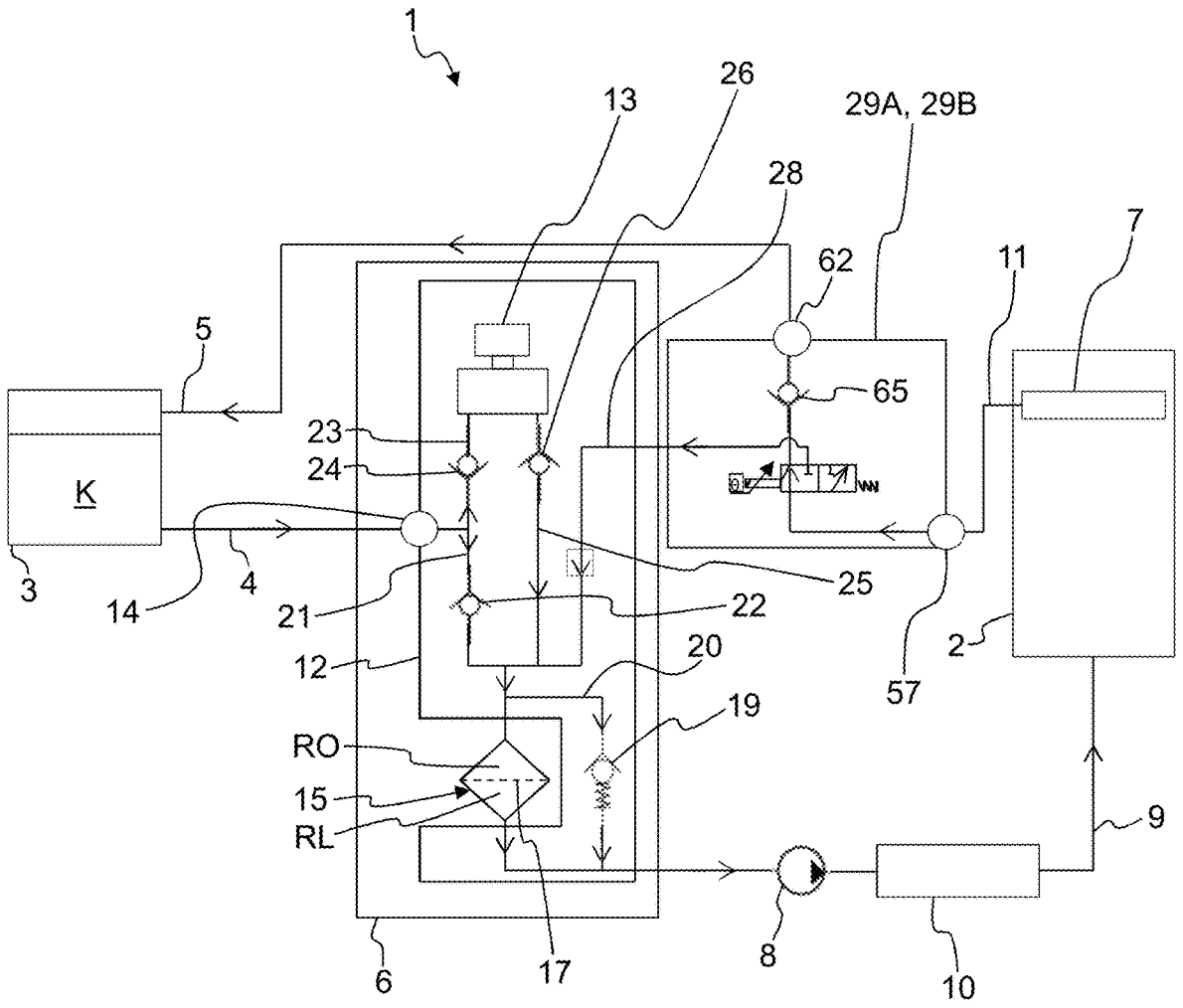
FIG. 1 shows a schematic view of an embodiment of an injection system of an internal combustion engine.

FIG. 1 shows a schematic view of an injection system 1 for an internal combustion engine 2. The internal combustion engine 2 can also be referred to as internal combustion machine or a combustion motor. In particular, the internal combustion engine 2 is a diesel engine. The injection system 1 is in particular a diesel injection system of a diesel engine. The injection system 1 is suitable for use in vehicles, in particular in motor vehicles. For example, the injection system 1 can be used in trucks, agriculturally used vehicles, construction machinery, construction vehicles but also rail vehicles. Moreover, the injection system 1 can also be used in passenger cars or stationary applications, for example, in generators.

The injection system 1 comprises a tank 3 for accommodating fuel K, in particular diesel fuel. A tank feed line 4 and a tank return line 5 are correlated with the tank 3. Moreover, a fuel prefilter unit 6 is associated with the injection system 1. The injection system 1 comprises a plurality of injection valves or fuel injectors, not illustrated. The fuel injectors are in fluid communication with a common distributor pipe 7 (common rail) and are supplied by the latter with fuel K. For pressure loading the common rail 7, a high-pressure pump 8 is arranged upstream thereof.

The injection system 1 comprises moreover a motor feed line 9 extending away from the fuel prefilter unit 6. By means of the motor feed line 9, the high-pressure pump 8 supplies the fuel K to the common rail 7. Downstream of the high-pressure pump 8, a fuel main filter 10 is provided at or in the motor feed line 9. The fuel prefilter unit 6 is positioned upstream of the high-pressure pump 8.

The fuel injectors are connected to a common engine return line 11 by means of which the heated and not yet combusted fuel K can be supplied again to the fuel prefilter unit 6. For example, the fuel K is heated due to friction when flowing through the high-pressure pump 8 and/or the fuel injectors and the corresponding lines and channels. In this context, up to 90% to 95% of the fuel K are returned uncombusted via the engine return line 11 back to the fuel prefilter unit 6.

Figure 2:
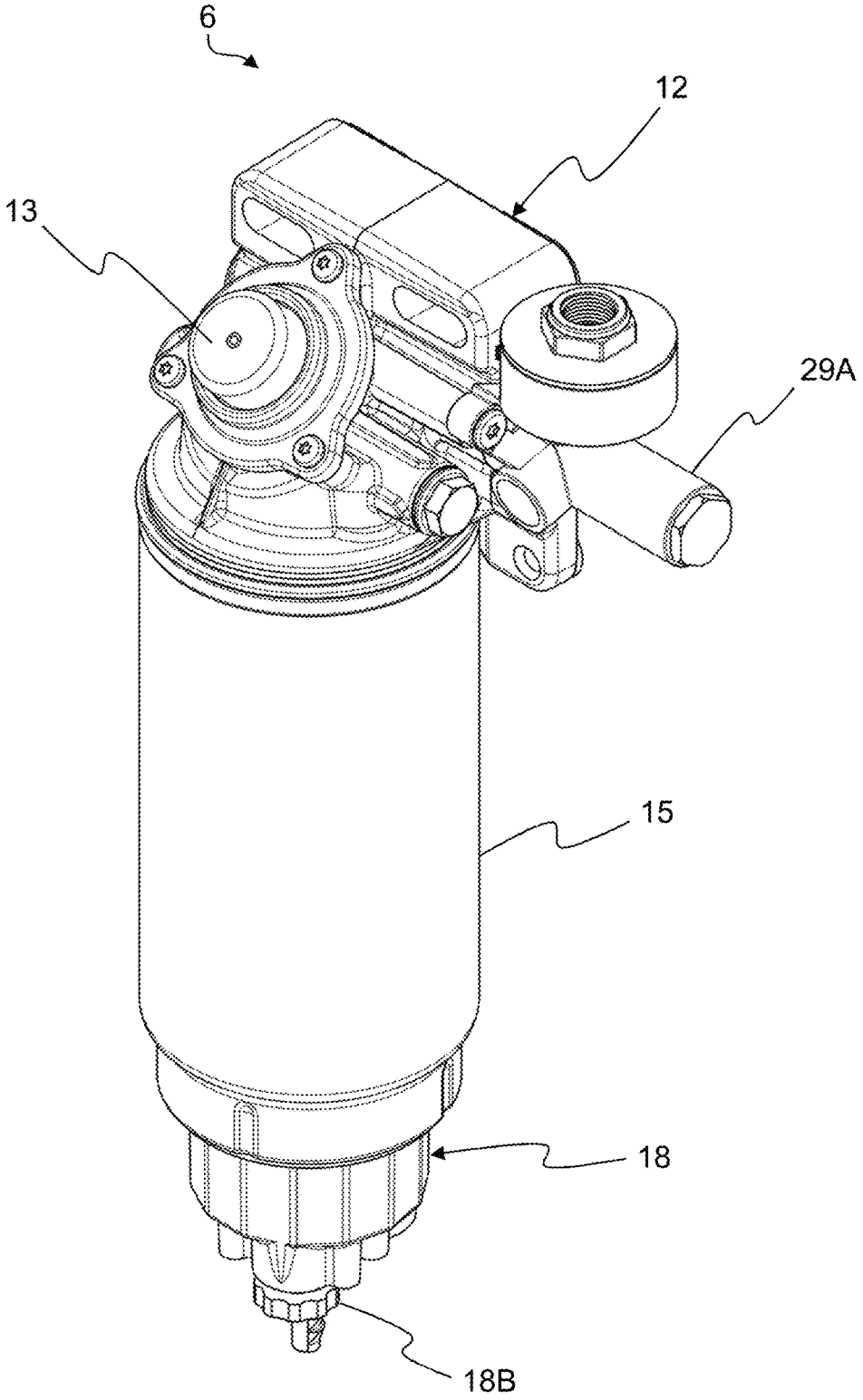
FIG. 2 shows a schematic perspective view of an embodiment of a fuel prefilter unit for the injection system according to FIG. 1.
Figure 3:
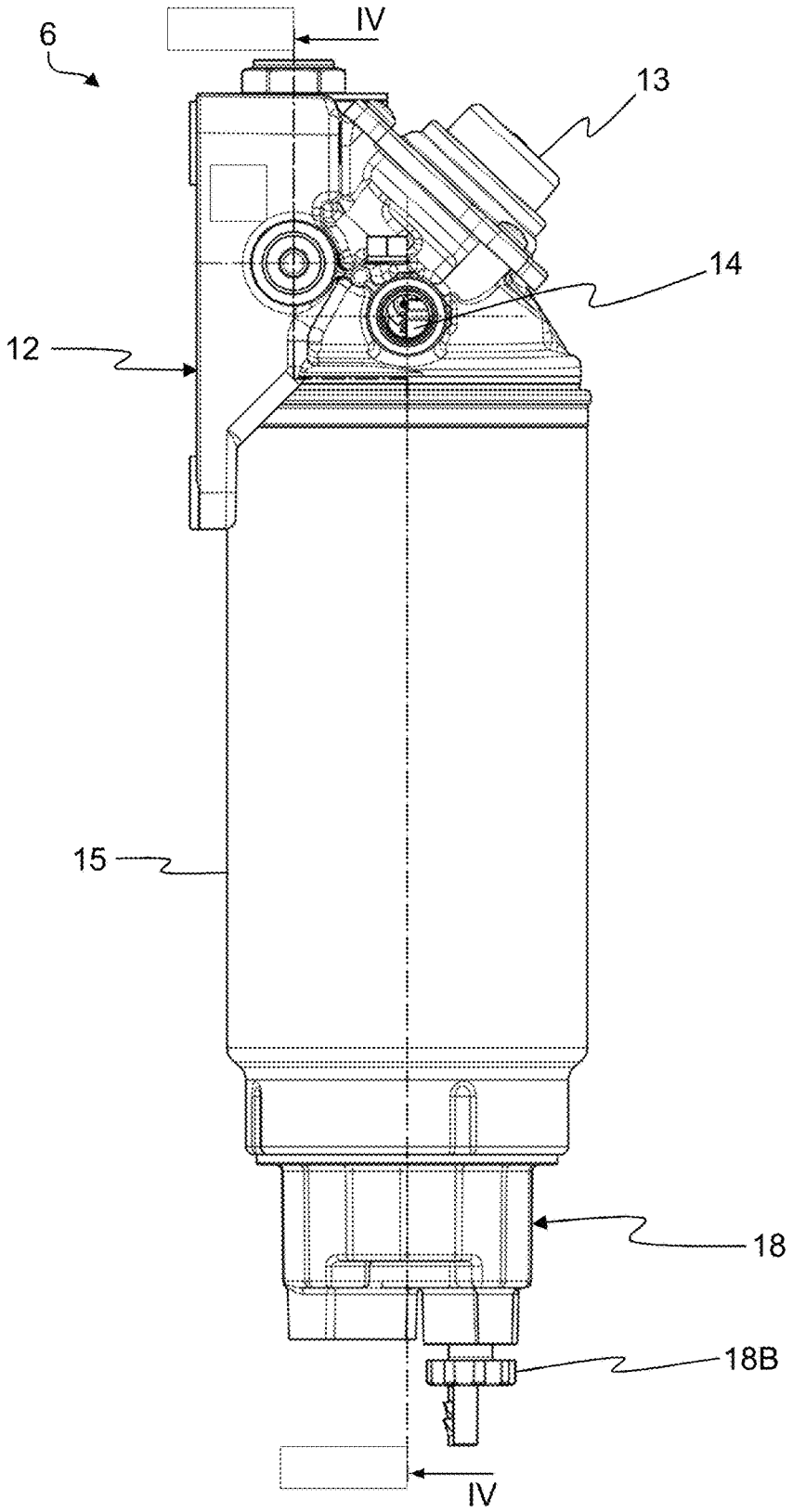
FIG. 3 shows a schematic side view of the fuel prefilter unit according to FIG. 2.
Figure 4:
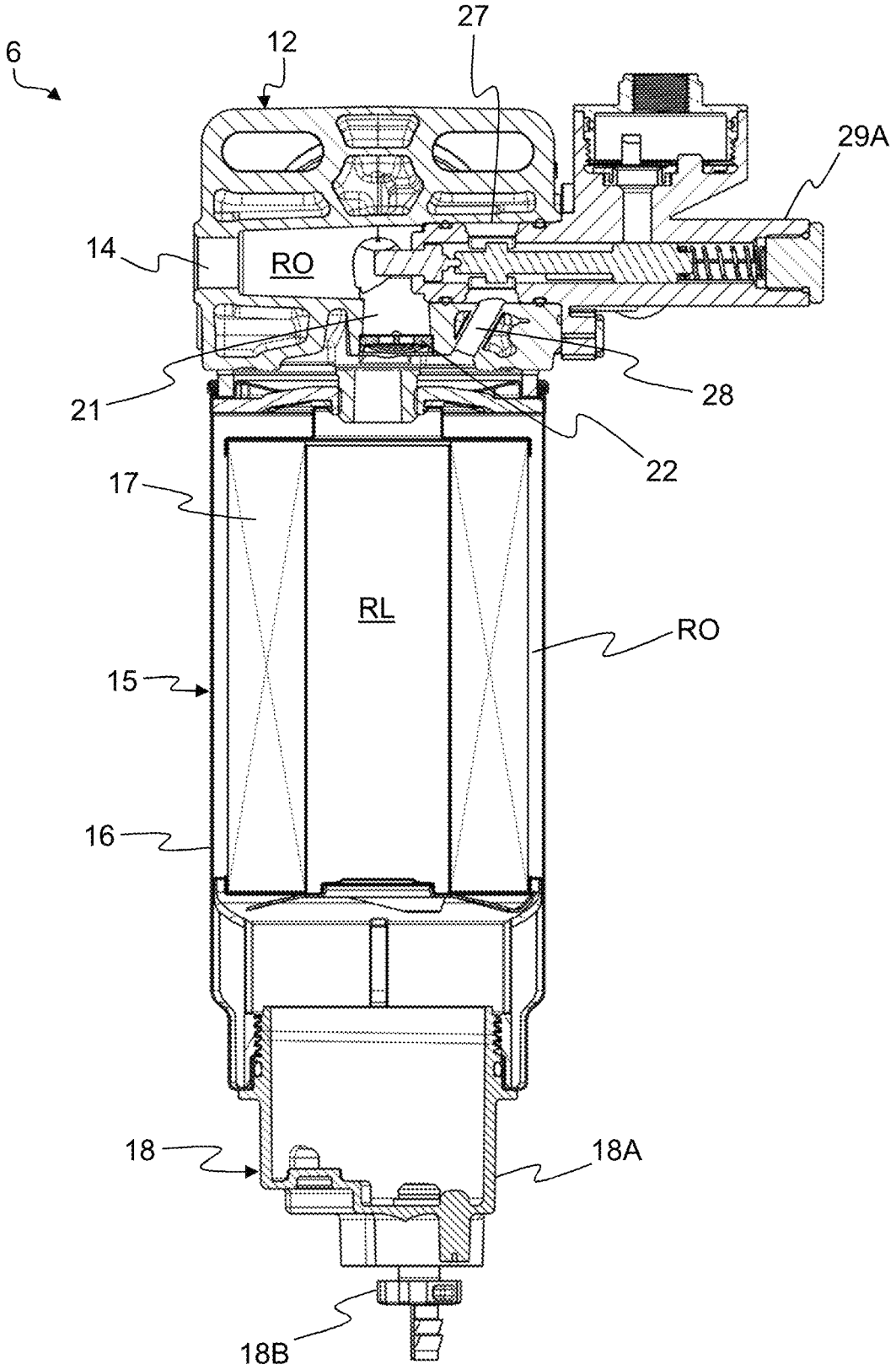
FIG. 4 shows a schematic section view of the fuel prefilter unit according to the section line IV-IV of FIG. 3.
Figure 5:
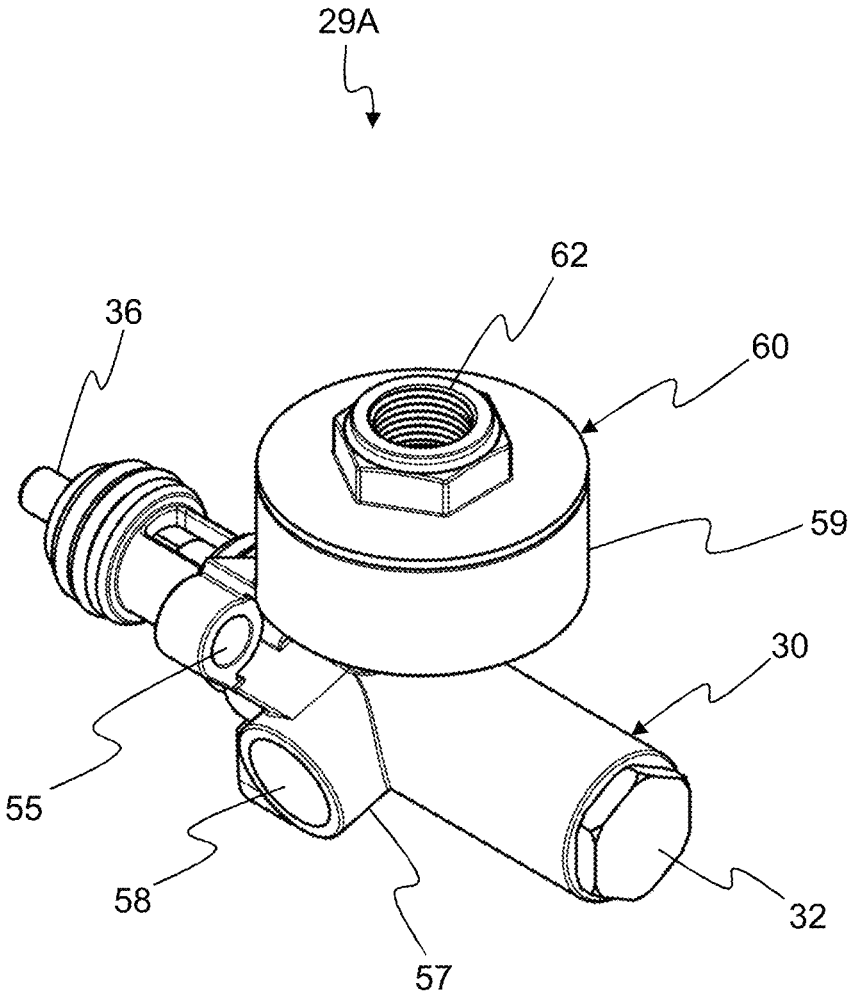
FIG. 5 shows a schematic perspective view of an embodiment of a recirculation module for the fuel prefilter unit according to FIG. 2.
Figure 6:
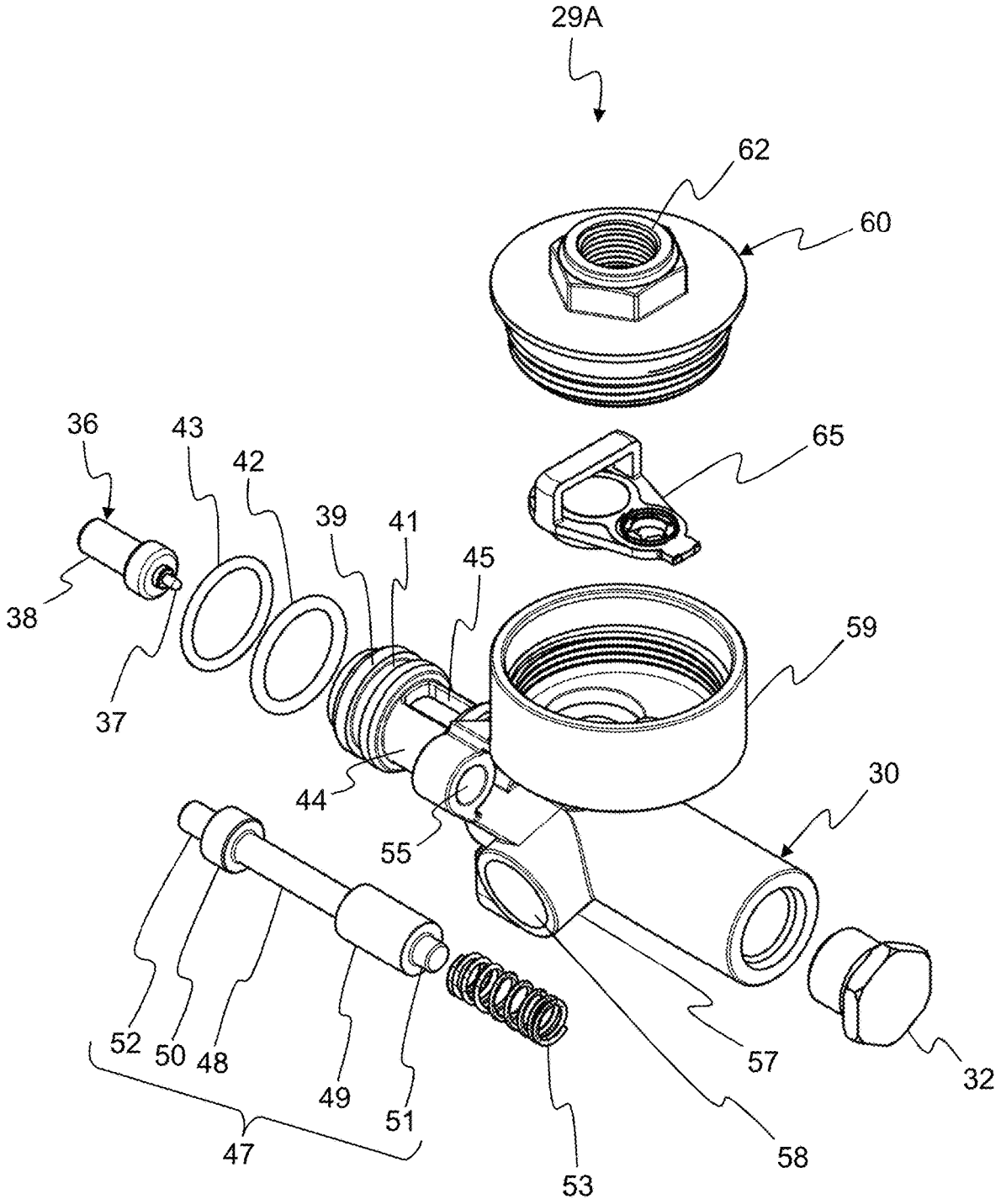
FIG. 6 shows a schematic perspective exploded view of the recirculation module according to FIG. 5.
Figure 7:
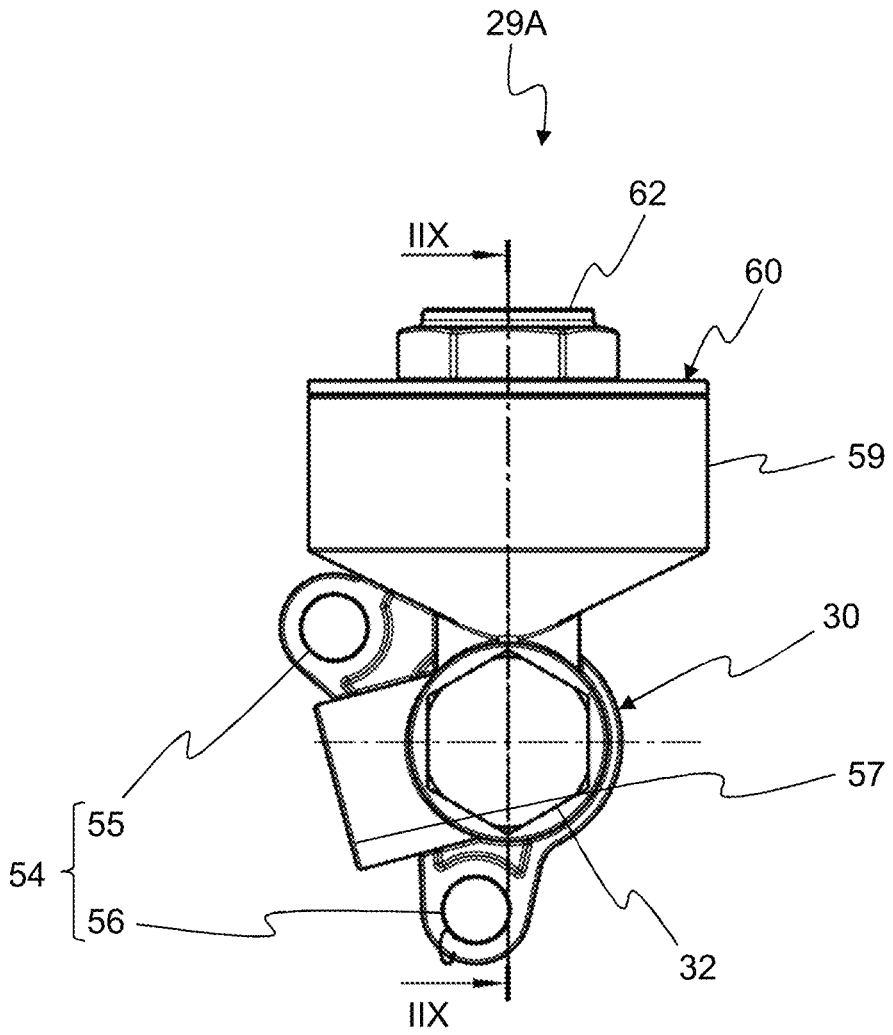
FIG. 7 shows a schematic side view of the recirculation module according to FIG. 5.

The fuel prefilter unit 6 illustrated in FIGS. 2 to 4 comprises a filter head 12 with a manual pump 13. The filter head 12 comprises a connector 14 to which the tank feed line 4 is connected. The connector 14 can be a bore or a channel provided in the filter head 12.

A filter element 15 is attached to the filter head 12. For example, the filter element 15 is screwed onto the filter head 12 or connected detachably thereto by means of a bayonet closure. The filter element 15 comprises a cylinder-shaped housing 16 in which a filter medium 17 is accommodated. The filter medium 17 can be a zigzag-folded fold bellows. The filter element 15 comprises a clean side RL and a raw side RO. For cleaning the fuel K, the fuel K flows through the filter medium 17 from the raw side RO to the clean side RL, i.e., the filter element 15 is flowed through radially from the exterior to the interior. The clean side RL is in fluid communication with the motor feed line 9. When exchanging the filter element 15, fuel K from the tank 3 can be pumped into the fuel prefilter unit 6 by means of the manual pump 13. In other embodiments which are not illustrated, the raw side RO can also be provided at a radially inwardly positioned circumference of the filter element 15 and the clean side RL at the radially outwardly positioned circumference of the filter element 15 so that the filter element 15 can be flowed through in radial direction from the interior to the exterior.

In the orientation of FIGS. 2 to 4, a water collecting chamber 18 is arranged at the bottom side at the filter element 15. For example, the water collecting chamber 18 is screwed into the filter element 15. The water collecting chamber 18 comprises a transparent housing 18A at which a drainage valve 18B is arranged for draining separated water from the housing 18A. The drainage valve 18B is to be manually actuated.

In the filter head 12, a valve 19, in particular a circumventing valve or a bypass valve, is provided that enables circumventing of the filter element 15. The valve 19 is preferably a spring-pretensioned check valve or ball valve. A bypass line or circumventing line 20 is correlated with the valve 19 that can connect in fluid communication the raw side RO to the clean side RL. The circumventing line 20 can be a bore provided in the filter head 12 or a channel provided in the filter head 12.

The tank feed line 4 is in fluid communication by means of a channel or a line 21 with the raw side RO. The line 21 comprises a valve 22, in particular a check valve. The valve 22 can be an umbrella valve or a ball valve. The manual pump 13 is in fluid communication by line 23 with the tank feed line 4. The line 23 comprises a valve 24, in particular a check valve. By a line 25, the manual pump 13 is in fluid communication with the raw side RO. The line 25 comprises a valve 26, in particular a check valve.

The fuel prefilter unit 6 and in particular the filter head 12 comprises an interface 27. The interface 27 can be a conically tapering bore which is provided in the filter head 12. The interface 27 is in fluid communication with the tank feed line 4, in particular with the connector 14. The interface 27 is suitable to accommodate an electrical heating module, not illustrated, that is configured to heat the fuel K supplied to the raw side RO of the filter element 15. When using diesel fuel, paraffins that precipitate therefrom at low ambient temperature and thus also at low fuel temperature may clog the filter element 15. By means of heating of the fuel K by the electrical heating module, the precipitation of paraffins can be prevented or they can be dissolved.

The interface 27 has correlated therewith a recirculation channel 28 which is provided in the filter head 12. The recirculation channel 28 connects in fluid communication the interface 27 with the raw side RO of the filter element 15 by circumventing the valve 22.

Figure 8:
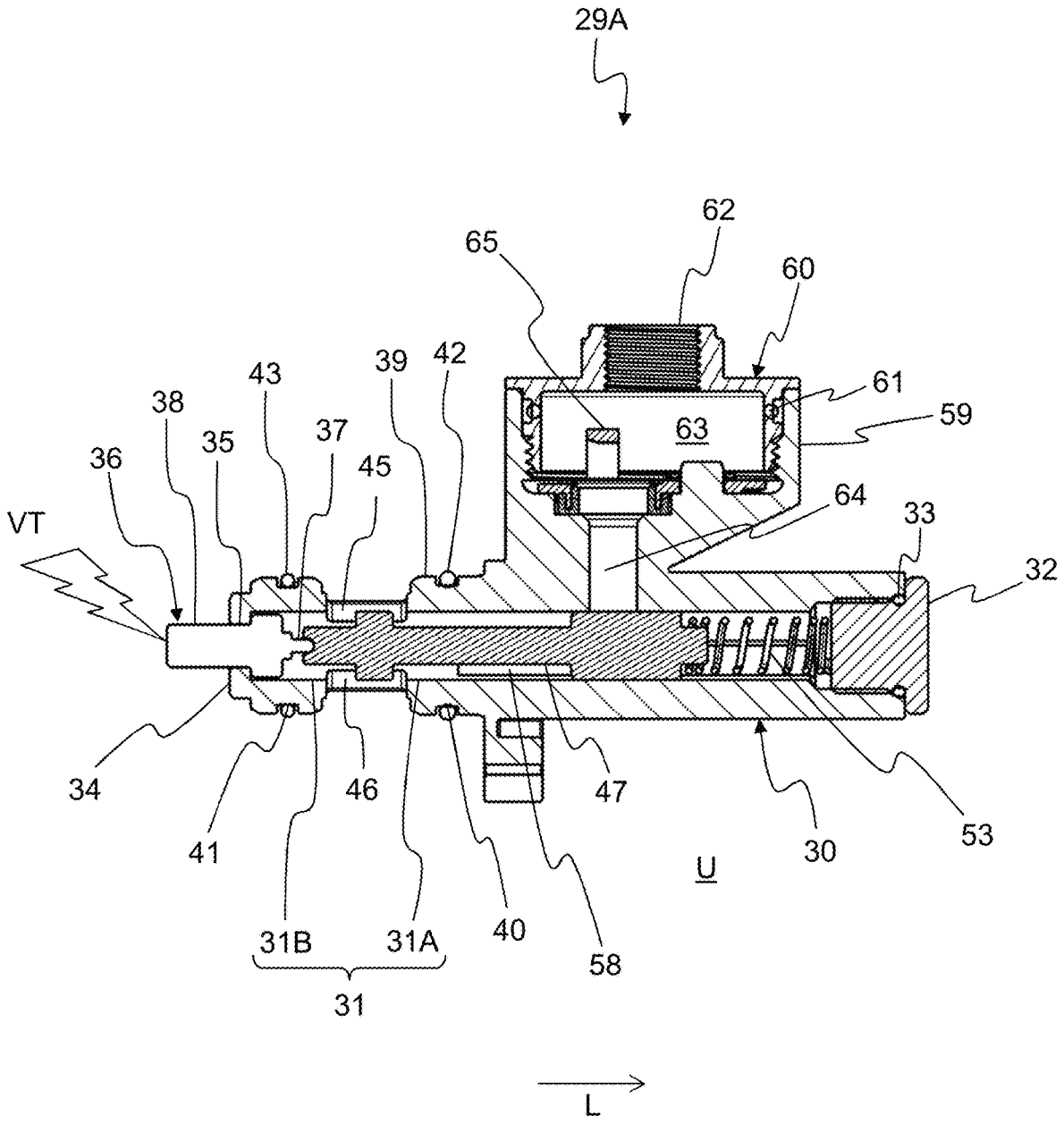
FIG. 8 shows a schematic section view of the recirculation module according to the section line IIX-IIX of FIG. 7.
Figure 9:
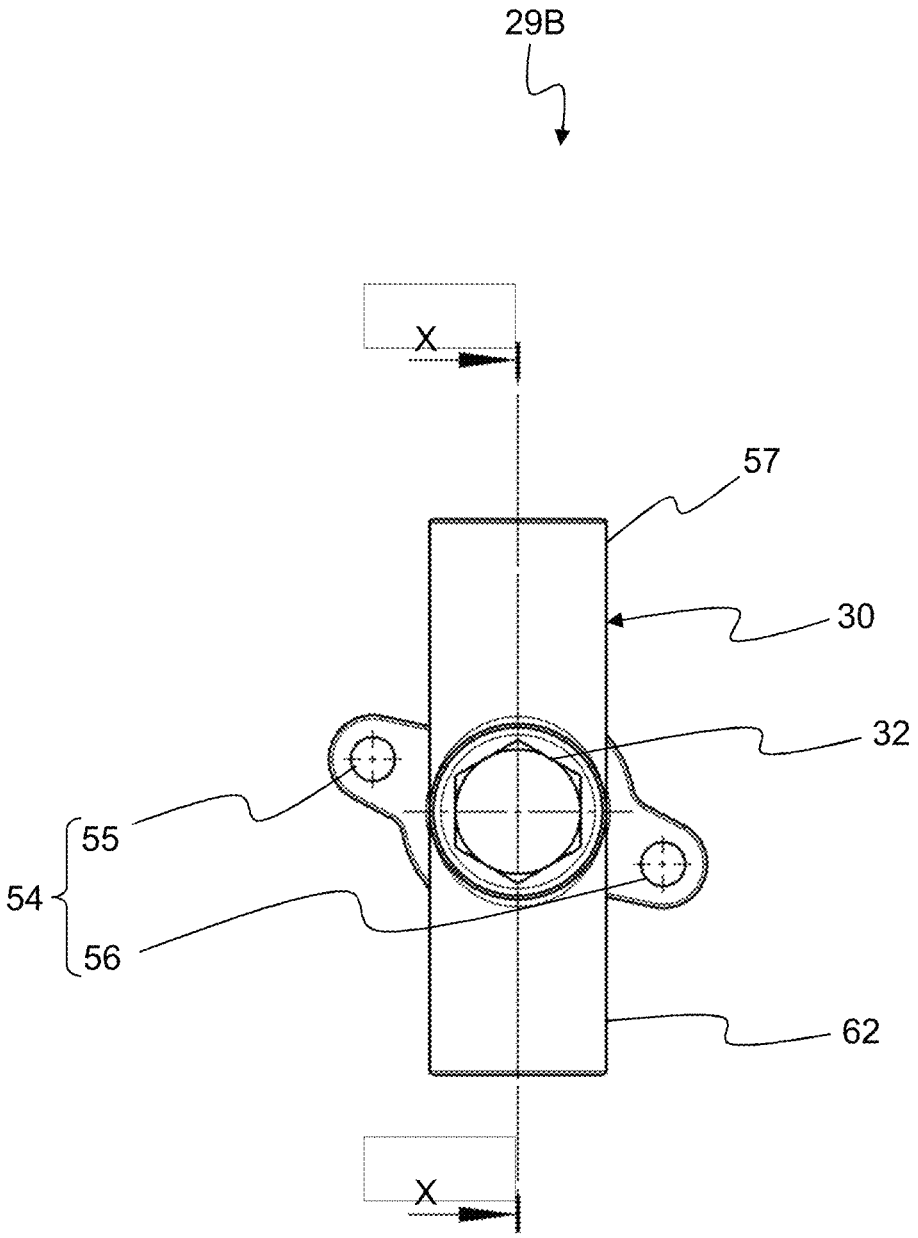
FIG. 9 shows a schematic side view of a further embodiment of a recirculation module for the fuel prefilter unit according to FIG. 2.

Presently, at the interface 27 there is however no electrical heating module attached but a recirculation module 29A. The recirculation module 29A can also be referred to as recirculation valve, cold start valve, cold start module, cold start manager or cold start valve device. The recirculation module 29A illustrated in FIGS. 5 to 8 comprises a module housing 30. The module housing 30 is substantially cylindrical and at least with sections thereof accommodated in the interface 27. A cylindrical bore 31 is centrally provided in the module housing 30. In the orientation of FIG. 8, the bore 31 is closed to the right by means of a closure screw 32 fluid-tightly. In this context, between the closure screw 32 and the module housing 30 a sealing element 33, in particular an O-ring, can be provided.

At an end section of the module housing 30 which is facing away from the closure screw 32, the bore 31 is closed by a wall 34. A bore 35 is provided in the wall 34 whose diameter is smaller than a diameter of the bore 31. A temperature-controlled actuating element 36 is accommodated in the bore 35. The actuating element 36 can also be referred to as actor or actuator. That the actuating element 36 is "temperature-controlled" is to be understood such that the actuating element 36 is configured to extend a plunger 37 linearly upon temperature increase and linearly retract the plunger 37 again upon temperature reduction. For example, the actuating element 36 can be a wax expansion element or wax motor but can also be a bimetal actor. The plunger 37 projects into the bore 31. A housing 38 of the actuating element 36 projects out of the bore 31.

The module housing 30 comprises moreover a preferably conical outer surface 39 which is of rotational symmetry and which comprises a geometry corresponding to that of the interface 27. The outer surface 39 comprises two annular grooves 40, 41 which are arranged spaced apart from each other and in which two sealing elements 42, 43, in particular O-rings, are accommodated. The module housing 30 is sealed relative to the interface 27 by means of the sealing elements 42, 43.

Between the two annular grooves 40, 41, a cylindrical outer surface 44 is provided. A diameter of the outer surface 44 in this context is dimensioned such that the outer surface 44 is radially recessed relative to the outer surface 39. The outer surface 44 is penetrated by a first or upper opening 45 and a second or lower opening 46. The openings 45, 46 connect the bore 31 in fluid communication with an environment U of the recirculation module 29A. The bore 31 comprises two bore sections 31A, 31B wherein in the orientation of FIG. 8 a first bore section 31A is positioned to the right of the openings 45, 46 and a second bore section 31B to the left of the openings 45, 46. The actuating element 36 projects into the second bore section 31B. The bore sections 31A, 31B have preferably an identical diameter.

A valve body 47 is received in the bore 31. The valve body 47 comprises a circular cylindrical base section 48 at which a first sealing section 49 and a second sealing section 50, arranged so as to be spaced apart from the first sealing section 49, are provided. The sealing sections 49, 50 and the base section 48 are embodied as one piece. The sealing sections 49, 50 comprise preferably an identical diameter which is however larger than a diameter of the base section 48. The diameter of the sealing sections 49, 50 corresponds preferably to the diameter of the bore 31 or is slightly smaller than the diameter of the bore 31. Viewed in a longitudinal direction of the valve body 47, the first sealing section 49 is longer than the second sealing section 50.

The base section 48 projects with a spring support section 51 past the first sealing section 49. Moreover, the base section 48 projects with an actuating section 52 past the second sealing section 50. At the front side of the actuating section 52 a depression is provided in which the plunger 37 of the actuating element 36 is accommodated. Between the first sealing section 49 and the closure screw 32, a spring element 53, in particular a pressure spring, is accommodated in the bore 31. In this context, the spring support section 51 is accommodated in the spring element 53.

The spring element 53 pretensions the valve body 47 in the direction toward the actuating element 36.

The bore 31 has associated therewith a longitudinal direction L. The longitudinal direction L is oriented from the wall 34 in the direction toward the closure screw 32, i.e., from the left to the right in the orientation of FIG. 8. The longitudinal direction L can however also be oriented in opposite direction. The valve body 47 can be linearly displaced by means of the actuating element 36 within the bore 31 in the longitudinal direction L. The spring element 53, on the other hand, can displace the valve body 47 within the bore 31 opposite to the longitudinal direction L.

The module housing 30 comprises a fastening interface 54 for fastening the recirculation module 29A at the filter head 12. The fastening interface 54 can comprise two bores 55, 56 that are arranged spaced apart from each other and displaced relative to each other. By means of the fastening interface 54, the recirculation module 29A can be screwed to the filter head 12. The fastening interface 54 is in this context identically embodied to a fastening interface of the aforementioned electrical heating module so that the heating module can be replaced easily by the recirculation module 29A.

A connector 57 is provided at the module housing 30 to which the engine return line 11 from the common rail 7 is connected. A first return channel 58 is formed in the connector 57. The first return channel 58 is in fluid communication with the bore 31, in particular with the first bore section 31A of the bore 31.

In the orientation of FIGS. 5 to 8 at the top side, a cup-shaped housing section 59 is provided at the module housing 30. The housing section 59 can be fluid-tightly closed by means of a cover 60. For this purpose, between the cover 60 and the housing section 59 a sealing element 61, in particular an O ring, can be arranged. For example, the cover 60 is screwed into the housing section 59. The cover 60 comprises a connector 62 to which the tank return line 5 to the tank 3 is connected. The connector 62 is in fluid communication with the bore 31 via an interior 63 of the housing section 59 and a second return channel 64. In the interior 63, a check valve 65 is accommodated. The check valve 65 can be a ball valve or an umbrella valve. The check valve 65 prevents a return flow of fuel K from the tank 3 through tank return line 5 into the recirculation module 29A.

The functionality of the fuel prefilter unit 6 or of the recirculation module 29A will be explained in the following with the aid of FIGS. 4 and 8. In this context, FIGS. 4 and 8 show the recirculation module 29A at a temperature of, for example, less than −5° C. This means the fuel K also has a temperature of less than −5° C. At this temperature, the plunger 37 of the actuating element 36 is retracted completely into the housing 38 so that the valve body 47 is completely moved to the left in the orientation of FIGS. 4 and 8.

This means that, in the orientation of FIGS. 4 and 8, the spring element 53 pushes the valve body 47 opposite to the longitudinal direction L maximally to the left. This position of the valve body 47 can be referred to as cold start state, cold start position, initial state or initial position. In the cold start state, the second sealing section 50 is arranged such that, viewed in the longitudinal direction L, the second sealing section 50 is positioned between side edges of the openings 45, 46. In other words, the second sealing section 50, viewed in the longitudinal direction L, is positioned between the bore sections 31A, 31B of the bore 31.

In the cold start state, the first sealing section 49 covers moreover the second return channel 64 so that the tank return line 5 to the tank 3 is closed. The first return channel 58 of the connector 57 which opens into the bore 31 is however not covered by the first sealing section 49 in the cold start state so that the engine return line 11 is in fluid communication with the recirculation channel 28 from the common rail 7 via the first return channel 58, the bore 31, and the openings 45, 46.

This means that in the cold start state the tank return line 5 to the tank 3 is closed. In other words, the tank return line 5 and the engine return line 11 are not in fluid communication. Instead, the heated fuel K flows via the engine return line 11, the first return channel 58, the bore 31, openings 45, 46, and the recirculation channel 28 to the raw side RO of the filter element 15. In this context, the still cold fuel K from the tank 3 flows about the housing 38 of the actuating element 36. The fuel K has in this context a filter raw side feed temperature VT. In this context, "filter raw side" means at the raw side RO of the filter element 15. The feed temperature VT may change during operation of the internal combustion engine 2, for example, increase.

Thus, a recirculation of the heated fuel return flows is realized. With increasing heating of the fuel K and thus a growing increase of the feed temperature VT, the plunger 37 of the actuating element 36 is moved farther and farther out of the housing 38. The valve body 47 is moved against the spring pretension of the spring element 53 in the longitudinal direction L until finally the second sealing section 50 of the valve body 47 is accommodated in the first bore section 31A of the bore 31. This means that the second sealing section 50 closes the first bore section 31A in the direction of the openings 45, 46 so that the first return channel 58 and thus also the engine return line 11 are no longer in fluid communication with the openings 45, 46 and thus also no longer with the recirculation channel 28.

Simultaneously with the second sealing section 50 entering the first bore section 31A, the first sealing section 49 is displaced such that the first sealing section 49 successively opens the second return channel 64 and thus connects the first return channel 58 via the bore 31, in particular via the first bore section 31A, with the second return channel 64. In a normal operating state of the valve body 47, the first bore section 31A is then completely closed in the direction toward the actuating element 36 and the tank return line 5 and the engine return line 11 are in fluid communication so that the fuel K which is returned from the common rail 7 is directly guided into the tank 3. The normal operating state can be referred to as normal operating position, final state or end position.

Between the cold start state and the normal operating state, any number of intermediate states of the valve body 47 are provided in which the heated fuel return flows can be guided partially through the filter element 15 and partially directly to the tank 3. The intermediate states can also be referred to as intermediate positions. The more heated fuel return flows are returned to the tank 3, the warmer is the fuel K supplied via the tank feed line 4 that then heats the actuating element 36 which is then moving the valve body 47 farther and farther in the longitudinal direction L until the end position is reached. This means the feed temperature VT increases continuously.

Figure 10:
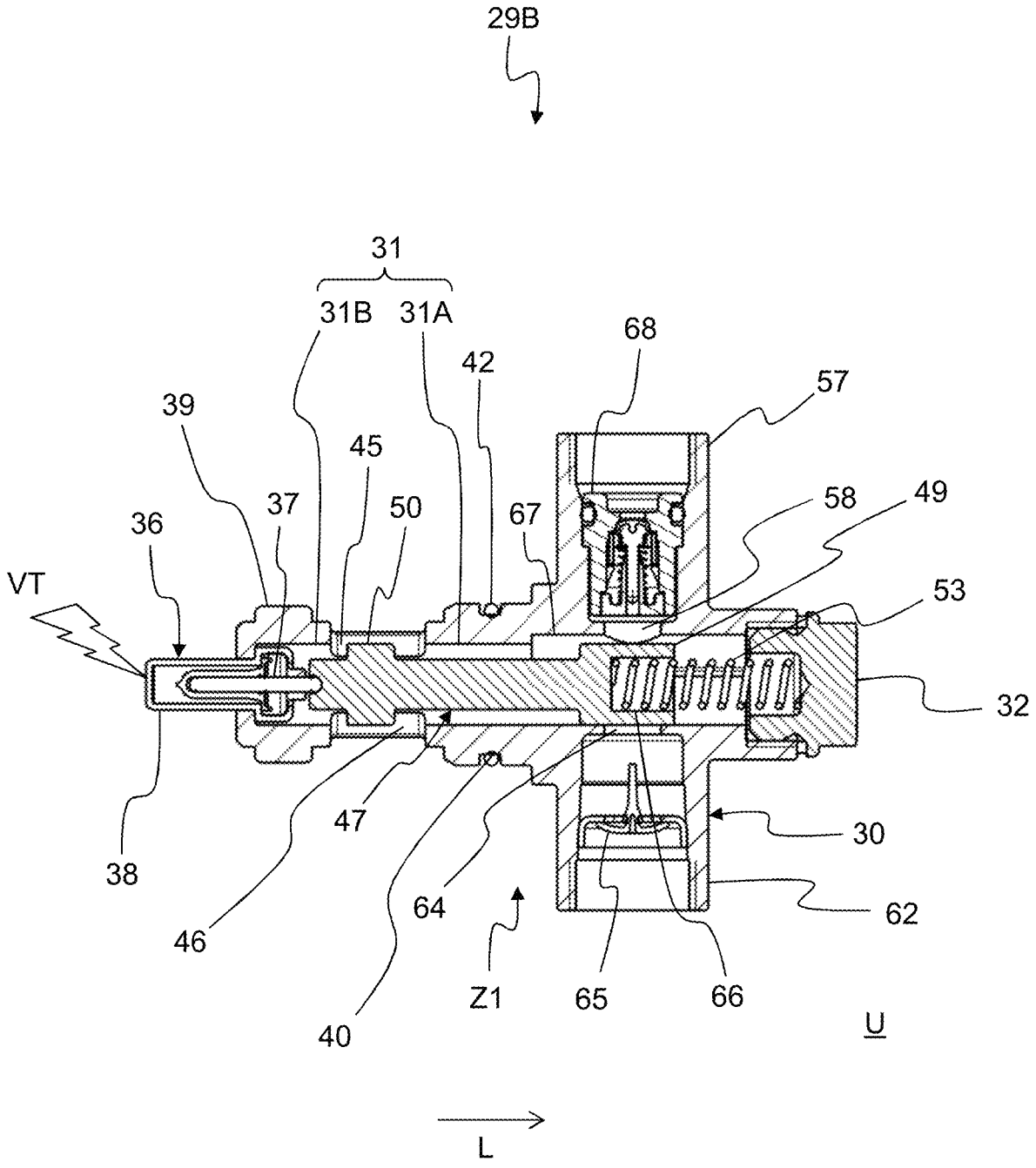
FIG. 10 shows a schematic section view of the recirculation module according to the section line X-X of FIG. 9.
Figure 11:
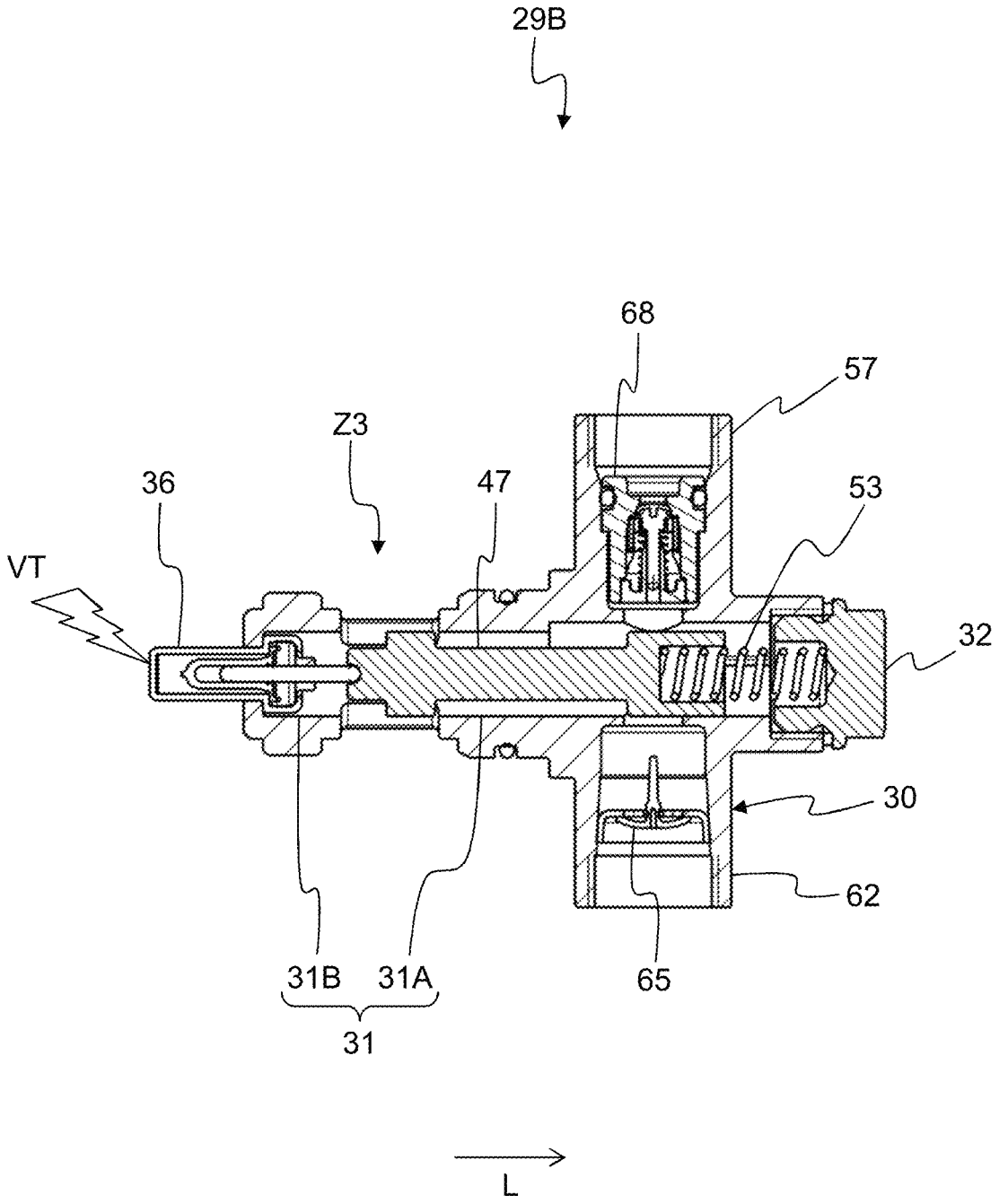
FIG. 11 shows again the schematic section view according to FIG. 10 with the plunger and valve body in displaced position.
Figure 12:
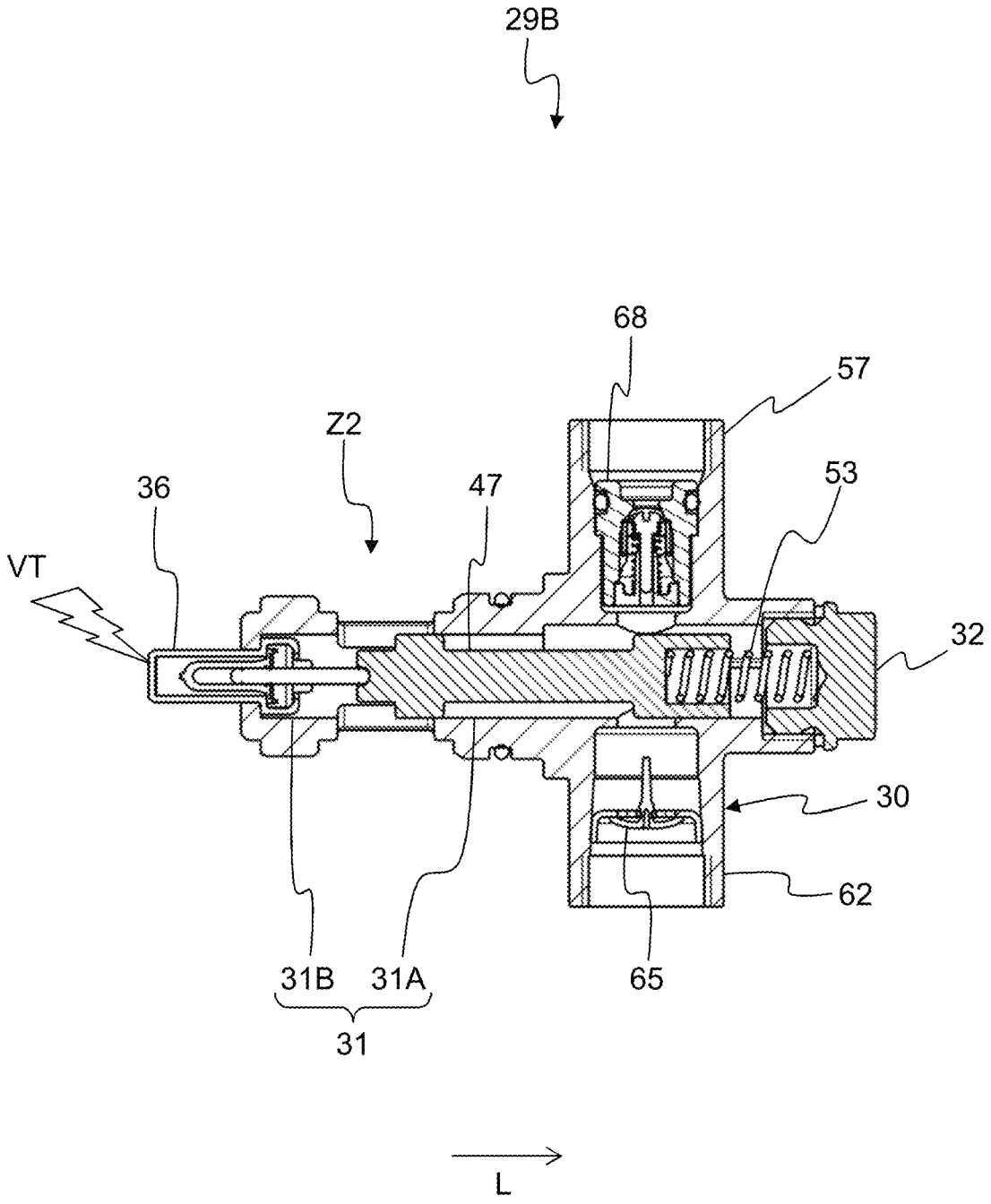
FIG. 12 shows again the schematic section view according to FIG. 10 with the plunger and valve body in a further displaced position.

FIGS. 9 through 12 show a further embodiment of a recirculation module 29B. FIG. 10 shows the recirculation module 29B at a temperature of less than −5° C., FIG. 11 shows the recirculation module 29B at a temperature of −5° C. to +5° C., and FIG. 12 shows the recirculation module 29 at a temperature of more than +5° C. In FIG. 10, the recirculation module 29B is in a cold start state Z1 as explained above, in FIG. 12 the recirculation module 29B is in a normal operating state Z2 as explained above, and in FIG. 11 the recirculation module 29B is in an intermediate state Z3 as explained above. The recirculation module 29B does not differ in its function compared to the recirculation module 29A. In the following only the constructive differences of the recirculation module 29B relative to the recirculation module 29A will be explained.

In this embodiment of the recirculation module 29B, the valve body 47 comprises, instead of a rod-shaped spring support section 51 which is accommodated in the spring element 53, a pocket-shaped spring accommodating section 66 in which the spring element 53 is received at least with sections thereof. Moreover, the check valve 65 is embodied as an umbrella valve that is received directly in the connector 62. In this way, space can be saved.

At the outer surface 39 of the module housing 30 only one annular groove 40 with a sealing element 42 is provided. The sealing element 42, viewed in the longitudinal direction L, is positioned between the openings 45, 46 and the connectors 57, 62. The bore 31 in which the valve body 47 is accommodated, comprises a widened portion 67 that has the effect that the valve body 47 never covers the first return channel 58. In particular, the widened portion 67 is provided at the first bore section 31A. The widened portion 67 can be, for example, a bore or pocket which is eccentrically displaced relative to the bore 31 and is provided in the module housing 30. An additional valve 68, in particular a check valve, is provided in the connector 57 or in the first return channel 58. The valve 68 prevents return flow of fuel K from the recirculation module 29B via the engine return line 11 to the common rail 7.

The functionality of the recirculation module 29B will be explained in the following. In FIG. 10, the recirculation module 29B or the valve body 47 is in the cold start state Z1. The cold start state Z1 can be in particular referred to as recirculation operating state. In the orientation of FIG. 10, the spring element 53 pushes the valve body 47 opposite to the longitudinal direction L maximally to the left. In the cold start state Z1, the second sealing section 50 is arranged such that the second sealing section 50 is positioned outside of the first bore section 31A and, viewed in the longitudinal direction L, at the level of the openings 45, 46.

In the cold start state Z1, moreover the first sealing section 49 covers the second return channel 64 so that the tank return line 5 to the tank 3 is closed. The first return channel 58 of the connector 57 that opens into the bore 31 is not covered by the first sealing section 49 in the cold start state Z1 because the widened portion 67 has a greater diameter than the first sealing section 49. This means that in the cold start state Z1 the engine return line 11 is in fluid communication with the recirculation channel 28 from the current common rail 7 via the first return channel 58, the bore 31, and the openings 45, 46.

This means that in the cold start state Z1 the tank return line 5 to the tank 3 is closed. In other words, the tank return line 5 and the engine return line 11 are not in fluid communication. Instead, the heated fuel K flows via the engine return line 11, the first return channel 58, the bore 31, the openings 45, 46, and the recirculation channel 28 to the raw side RO of the filter element 15. In doing so, the still cold fuel K from the tank 3 flows about the housing 38 of the actuating element 36 at the feed temperature VT.

FIG. 11 shows the recirculation module 29B or the valve body 47 in the intermediate state Z3 in which the second sealing section 50 is just being moved into the first bore section 31A of the bore 31 and the first sealing section 49 is just about to open the second return channel 64. This means the fluid communication between the tank return line 5 and the engine return line 11 is just about to be effected and the recirculation is terminated. In the intermediate state Z3, heated fuel return flows from the common rail 7 are partially supplied to the tank 3 and partially to the raw side RO of the filter element 15. As mentioned above, any number of intermediate states may be provided.

FIG. 12 shows the recirculation module 29B or the valve body 47 in the normal operating state Z2 in which the actuating element 36 has moved the valve body 47 in the orientation of FIG. 12 maximally to the right. In the normal operating state Z2, the second sealing section 50 closes the first bore section 31A of the bore 31 in the direction of the actuating element 36 completely and the first sealing section 49 opens the second return channel 64. The entire fuel return flow from the common rail 7 is thus supplied to the tank 3. In the normal operating state Z2, no heated fuel return flows are supplied any longer to the filter element 15.

By means of the afore explained embodiments of the recirculation module 29A, 29B, a simple exchange of an electrical heating module is possible. The precipitation of paraffins in the filter element 15 is reliably prevented. In this way, the cold start properties of the injection system 1 or of the internal combustion engine 2 are significantly improved.

Figure 13:
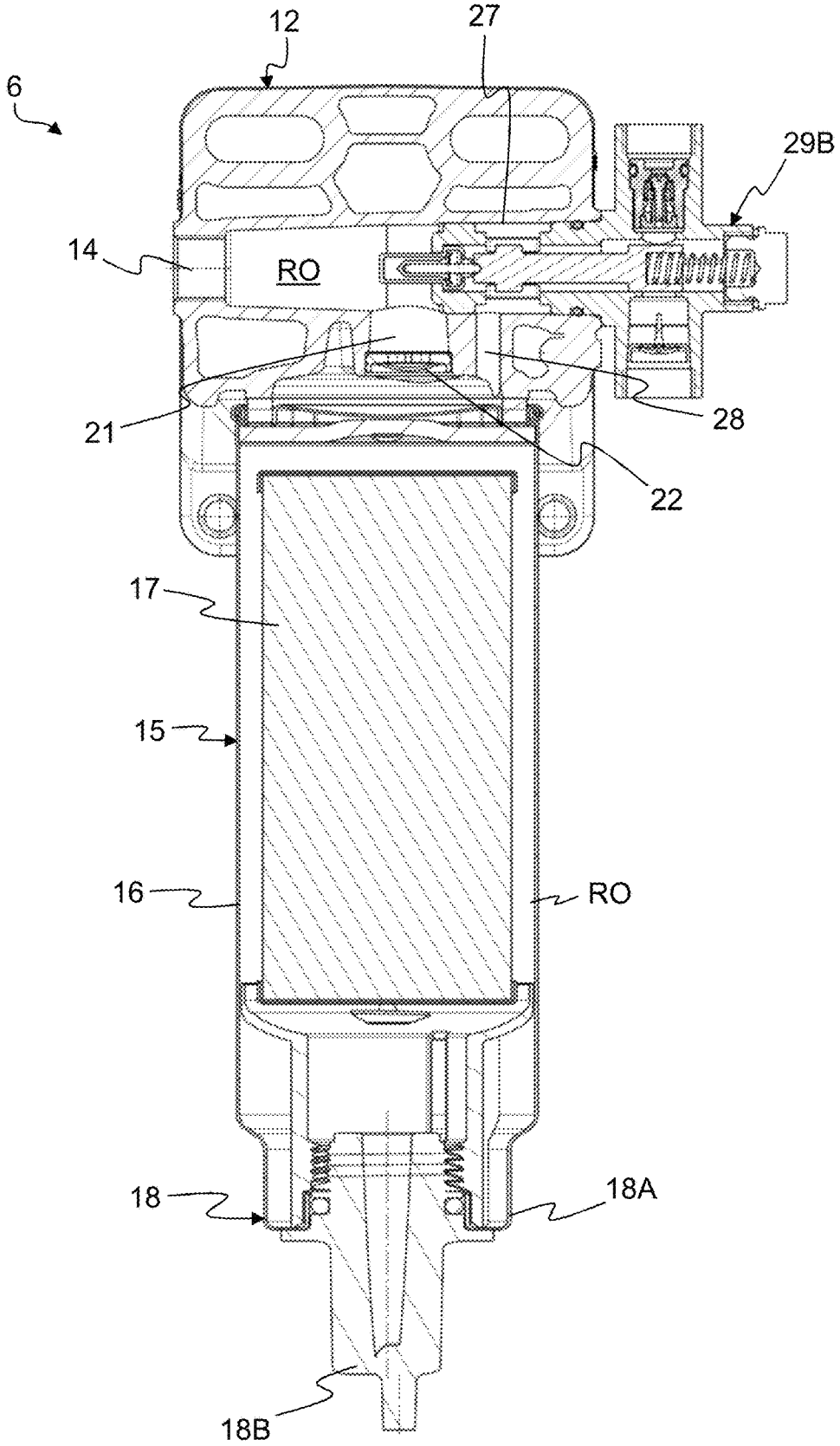
FIG. 13 shows a longitudinal section view of a fuel prefilter unit with the recirculation module according to FIG. 9.

In FIG. 13, the recirculation module 29B already described in FIGS. 9 through 12 is illustrated in a state installed in a filter head 12 in a fuel prefilter unit 6. Installation position and functionality correspond to the fuel prefilter unit 6 that has already been explained in great detail in regard to FIGS. 2 to 4. The raw side is positioned here at the radially outer circumference of the filter element 15.

REFERENCE CHARACTERS

1 injection system
2 internal combustion engine
3 tank
4 tank feed line
5 tank return line
6 fuel prefilter unit
7 common rail
8 high-pressure pump
9 motor feed line
10 fuel main filter
11 engine return line
12 filter head
13 manual pump
14 connector
15 filter element
16 housing
17 filter medium
18 water collecting chamber
18A housing
18B drainage valve
19 valve
20 circumventing line
21 line
22 valve
23 line
24 valve
25 line
26 valve
27 interface
28 recirculation channel
29A recirculation module
29B recirculation module
30 module housing
31 bore
31A bore section
31B bore section
32 closure screw
33 sealing element
34 wall
35 bore
36 actuating element
37 plunger
38 housing
39 outer surface
40 annular groove
41 annular groove
42 sealing element
43 sealing element
44 outer surface
45 opening
46 opening
47 valve body
48 base section
49 sealing section
50 sealing section
51 spring support section
52 actuating section
53 spring element
54 fastening interface
55 bore
56 bore
57 connector
58 first return channel
59 housing section
60 cover
61 sealing element
62 connector
63 interior
64 second return channel

65 check valve
66 spring accommodation section
67 widened portion
68 valve
K fuel
L longitudinal direction
RL clean side
RO raw side
U environment
VT feed temperature
Z1 cold start state
Z2 normal operating state
intermediate state

What is claimed is:

1. A recirculation module for a fuel prefilter unit for filtering fuel to be supplied to an internal combustion engine, the recirculation module comprising:

a module housing;

a check valve accommodated in the module housing;

a temperature-controlled actuating element accommodated in the module housing and configured to transfer the recirculation module, as a function of a filter raw side feed temperature of the fuel, from a cold start state into a normal operating state and from the normal operating state into the cold start state;

wherein, in the cold start state, the recirculation module is configured to enable fluid communication of an engine return line, extending from the internal combustion engine to the recirculation module, with a raw side of a filter element of the fuel prefilter unit and is configured to separate the engine return line in regard to fluid communication from a tank return line of a tank of the internal combustion engine;

wherein, in the normal operating state, the recirculation module is configured to separate the engine return line in regard to fluid communication from the raw side of the filter element of the fuel prefilter unit and configured to enable fluid communication of the engine return line with the tank return line;

wherein the check valve prevents a return flow of fuel from the tank return line into the engine return line;

wherein the temperature-controlled actuating element is configured to transfer the recirculation module into an intermediate state, wherein the intermediate state is provided between the cold start state and the normal operating state, wherein, in the intermediate state, the recirculation module is configured to enable fluid communication of the engine return line with the raw side of the filter element and enable fluid communication of the engine return line with the tank return line.

2. The recirculation module according to claim 1, further comprising a valve body accommodated in the module housing, wherein the temperature-controlled actuating element is operatively connected to the valve body to linearly displace the valve body in the module housing in order to transfer the recirculation module from the cold start state into the normal operating state and from the normal operating state into the cold start state.

3. The recirculation module according to claim 2, further comprising a spring element accommodated in the module housing and configured to pretension the valve body in a direction toward the temperature-controlled actuating element.

4. The recirculation module according to claim 2, wherein the valve body comprises a first sealing section and a second sealing section arranged spaced apart from the first sealing section, wherein the first sealing section is configured to separate in regard to fluid communication the engine return line from the tank return line in the cold start state, and wherein the second sealing section is configured to separate in regard to fluid communication the engine return line from the raw side of the filter element of the fuel prefilter unit in the normal operating state.

5. The recirculation module according to claim 4, further comprising a first return channel and a second return channel, wherein:

the module housing comprises a bore and further comprises at least one opening, wherein the bore is in fluid communication with the at least one opening and wherein the at least one opening is in fluid communication with the raw side of the filter element of the fuel prefilter unit;

the temperature-controlled actuating element and the valve body are accommodated in the bore;

the first return channel opens into the bore and is in fluid communication with the engine return line;

the second return channel opens into the bore and is in fluid communication with the tank return line;

in the cold start state, the first sealing section closes the second return channel and the second sealing section is arranged such that the at least one opening is in fluid communication with a first bore section of the bore;

in the normal operating state, the first sealing section opens the second return channel and the second sealing section is arranged such that the at least one opening is separated in regard to fluid communication from the first bore section;

the valve body closes the first return channel neither in the cold start state nor in the normal operating state.

6. The recirculation module according to claim 1, wherein the module housing comprises an outer surface which is configured to correspond to an interface provided at the fuel prefilter unit and configured to accommodate an electrical heating module.

7. The recirculation module according to claim 6, further comprising at least one sealing element provided at the outer surface and configured to fluid-tightly seal the module housing relative to the interface.

8. The recirculation module according to claim 7, wherein the at least one sealing element is an O-ring.

9. The recirculation module according to claim 6, further comprising two axially spaced apart sealing elements arranged at the outer surface.

10. The recirculation module according to claim 6, wherein the module housing comprises a bore and further comprises at least one opening in fluid communication with the bore, wherein the two axially spaced apart sealing elements are arranged at axial positions that adjoin the at least one opening at opposite sides thereof.

11. The recirculation module according to claim 1, wherein the temperature-controlled actuating element projects out of the module housing.

12. A fuel prefilter unit for filtering fuel of an internal combustion engine, the fuel prefilter unit comprising:

a filter head comprising an interface;

a filter element arranged at the filter head;

a recirculation module according to claim 1, wherein the module housing of the recirculation module is accommodated at least with sections thereof in the interface;

wherein the temperature-controlled actuating element of the recirculation module at least with sections thereof is arranged at a raw side of the filter element.

* * * * *